US007617888B2

(12) United States Patent
Barbera

(10) Patent No.: US 7,617,888 B2
(45) Date of Patent: Nov. 17, 2009

(54) PILOT TUBE SYSTEM AND ATTACHMENT MECHANISM FOR AUGER BORING MACHINE

(76) Inventor: James S. Barbera, 1635 37th St. NW., Canton, OH (US) 44709

( * ) Notice: Subject to any disclaimer, the term of this patent is extended or adjusted under 35 U.S.C. 154(b) by 117 days.

(21) Appl. No.: 11/715,026

(22) Filed: Mar. 7, 2007

(65) Prior Publication Data

US 2008/0217061 A1 Sep. 11, 2008

(51) Int. Cl.
*E02D 29/00* (2006.01)
*E21D 1/06* (2006.01)

(52) U.S. Cl. ..... 175/62; 175/53; 175/220

(58) Field of Classification Search ..... 175/62, 175/53, 122, 162, 220; 405/138
See application file for complete search history.

(56) References Cited

U.S. PATENT DOCUMENTS 1,932,068 A * 10/1933 Englebright et al. ..... 173/24
2,338,351 A * 1/1944 Parrish ..... 173/187
3,451,491 A * 6/1969 Clelland ..... 173/44
3,612,195 A * 10/1971 Richmond ..... 175/122
3,902,563 A * 9/1975 Dunn ..... 175/62
4,024,721 A * 5/1977 Takada et al. ..... 405/184
6,206,109 B1 3/2001 Monier et al.

* cited by examiner

*Primary Examiner*—David J Bagnell
*Assistant Examiner*—Cathleen R Hutchins
(74) *Attorney, Agent, or Firm*—Sand & Sebolt

(57) ABSTRACT

A pilot tube drive assembly used with an auger boring machine includes a height adjustment mechanism for aligning the pilot tube path of travel with an axis about which an auger of the machine rotates during trenchless installation of underground pipe. A drive mechanism mounted on a drive assembly frame drives the pilot tube to form a pilot hole in the ground for guiding the auger. The height adjustment mechanism may include shorter and taller mounting assemblies which are typically removably mounted on the drive assembly frame. The shorter and taller mounting assemblies may be alternately mounted on the frame at the same location. Typically, the mounting assemblies are removably mounted on spaced rails of an auger boring machine frame via mounting legs which are removably inserted into openings in the spaced rails by an actuating mechanism between the rails.

20 Claims, 11 Drawing Sheets

PILOT TUBE SYSTEM AND ATTACHMENT MECHANISM FOR AUGER BORING MACHINE

BACKGROUND OF THE INVENTION

1. Technical Field

The invention relates generally to an auger boring machine and a method of use in the trenchless installation of underground pipe. More particularly, the invention relates to such a machine which utilizes a pilot tube for forming a pilot hole for guiding the auger of the machine. Specifically, the invention relates to an attachment mechanism for a pilot tube drive assembly which allows the height of the drive assembly to be changed for use with auger drives of different heights.

2. Background Information

The use of an auger boring machine for installing underground pipe between two locations without digging a trench there between is broadly known. In addition, it is known to use a pilot tube formed of a plurality of pilot tube segments to create a pilot hole for guiding an auger which bores a larger hole so that the auger remains within a reasonably precise line and grade. For example, see U.S. Pat. No. 6,206,109 granted to Monier et al. However, auger boring machines have rotational auger drives which are positioned at a given height typically depending on the size of the auger to be used with the given machine. Because of the different heights of the auger drive of these machines, there is a need for a pilot drive assembly the height of which can be adjusted in order to drive a pilot hole at a height suitable for the given auger boring machine.

BRIEF SUMMARY OF THE INVENTION

The present invention provides an apparatus comprising a pilot tube engaging member adapted to drivingly engage an auger boring machine pilot tube to form in the ground a pilot hole for guiding an auger; a drive mechanism for driving the engaging member along a laterally extending axis; and a height adjustment mechanism for adjusting the height of the engaging member and axis.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
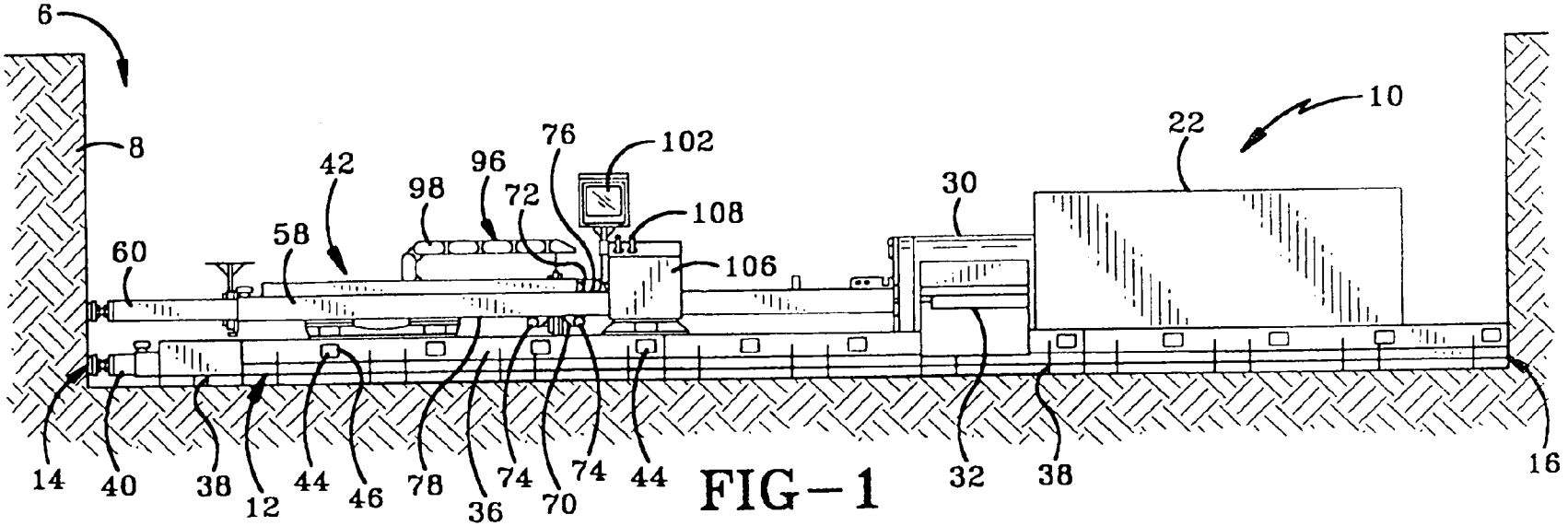
FIG. 1 is a side elevational view of a first embodiment of the auger boring machine of the present invention shown in a pit formed in the earth.
Figure 2:
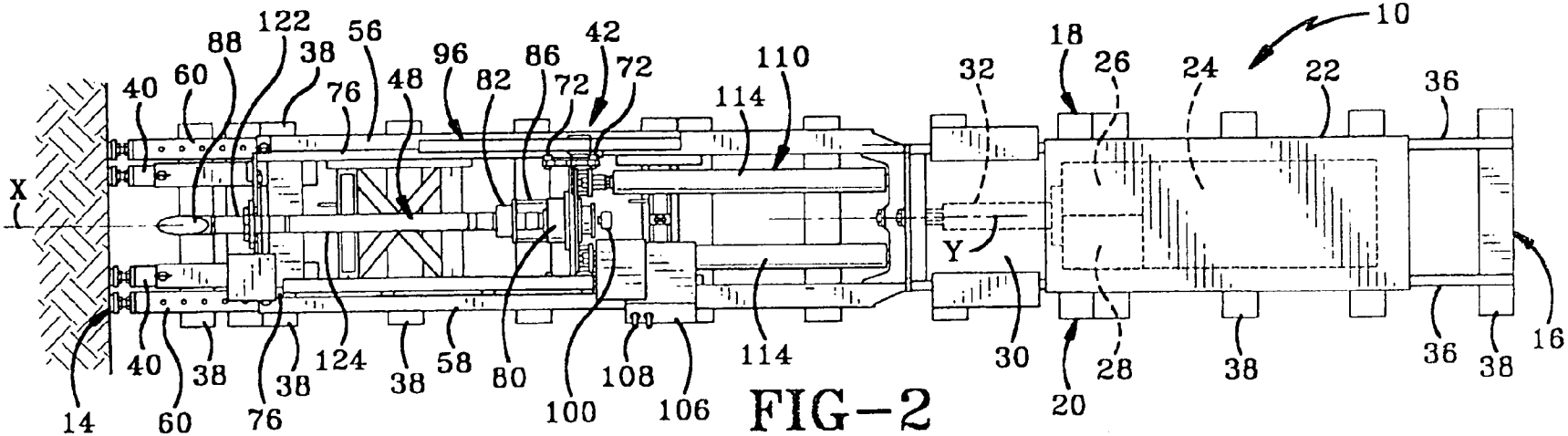
FIG. 2 is a top plan view of the first embodiment.
Figure 13:
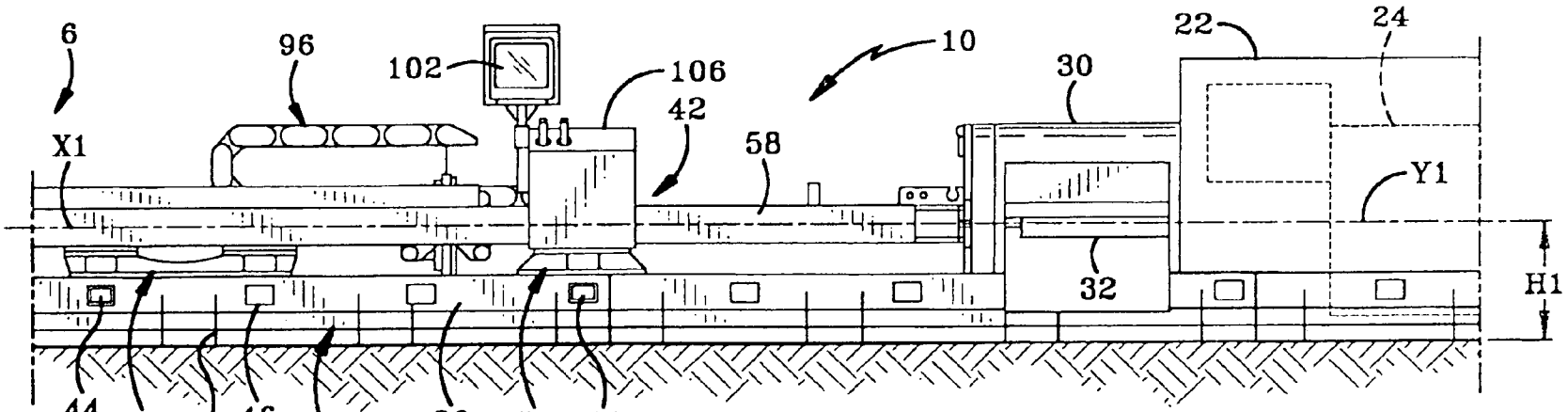
FIG. 13 is a side elevational view showing the drive assembly mounted on the frame of the first auger boring machine via the shorter mounting assemblies.
Figure 16:
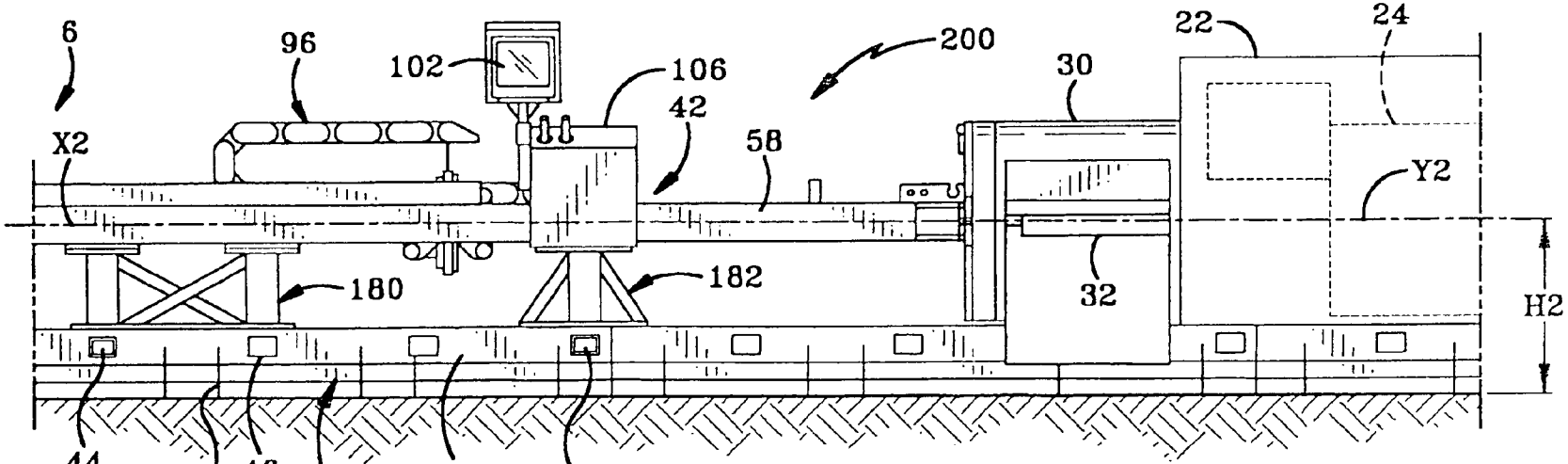
FIG. 16 is a side elevational view similar to FIG. 13 showing the drive assembly mounted on a second auger boring machine so that the height of the drive assembly is greater than that when mounted with the shorter mounting assemblies of FIG. 13.

A first embodiment of the auger boring machine of the present invention is indicated generally at 10 in FIGS. 1, 2 and 13; and a second embodiment is indicated generally at 200 in FIG. 16. Referring to FIG. 1, machine 10 is typically disposed in a pit 6 formed in the earth's soil or ground 8 and configured to bore a hole through ground 8 for the purpose of laying underground pipe in the bored hole. Machine 10 typically bores a hole from within a pit such as pit 6 to another pit which may be spaced several hundred feet away. Machine 10 includes a frame 12 which extends from a front end 14 to a rear end 16 of machine 10. Front and rear end 14 and 16 define there between an axial direction of machine 10. Machine 10 further has first and second opposed sides 18 and 20 (FIG. 2) defining there between a lateral direction of machine 10.

An engine compartment 22 is mounted on frame 12 and houses therein a fuel powered engine 24, an electric generator 26 powered by engine 24 and a hydraulic pump 28 also powered by engine 24. An auger drive compartment 30 is disposed in front of compartment 22 and houses therein an auger drive having a rotational output shaft 32 for rotationally driving an auger 34 (FIG. 25). Frame 12 further includes a pair of spaced axially extending rails 36 secured to a plurality of cross bars 38 which are mounted on ground 8 in the bottom of pit 6. A pair of adjustable stabilizing poles 40 are telescopically received in and adjustably mounted respectively on rails 36 and configured to press against the wall of ground 8 which bounds pit 6.

Figure 3:
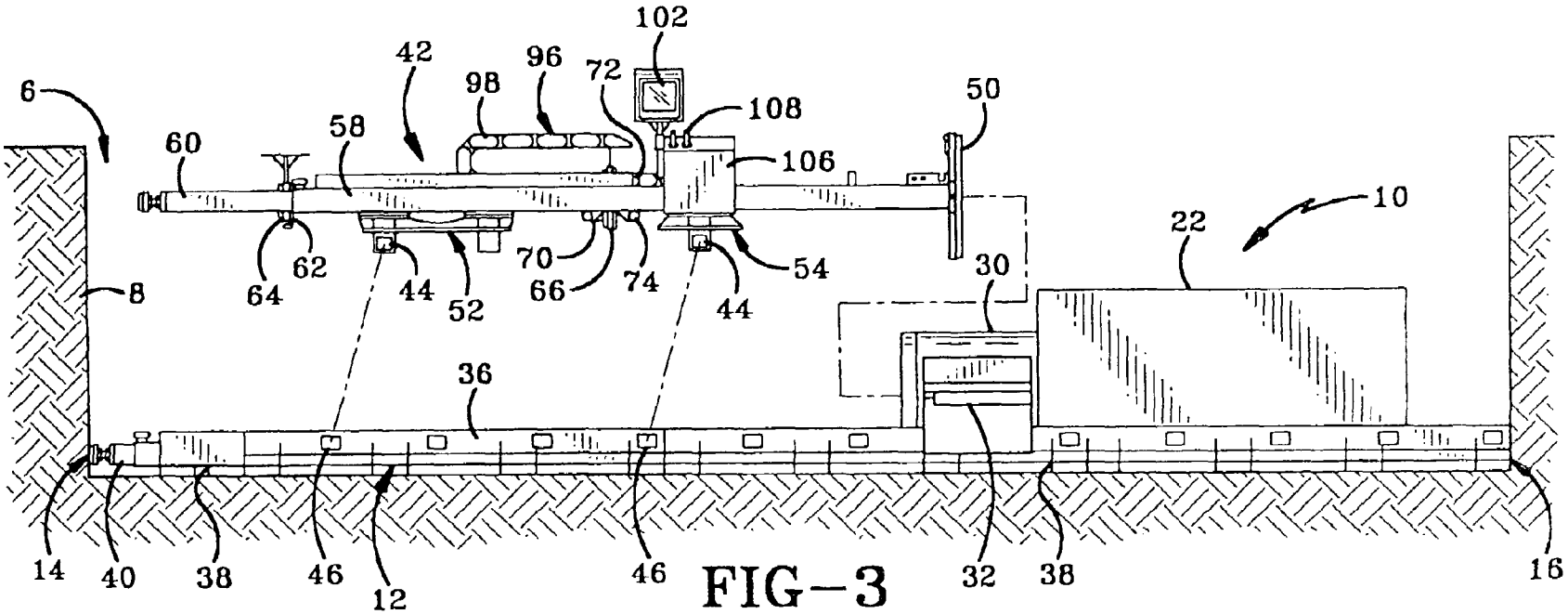
FIG. 3 is a side elevational view similar to FIG. 1 showing the pilot tube drive assembly removed from the frame of the boring machine.

In accordance with a feature of the invention, a pilot tube guidance and drive assembly 42 is removably mounted on frame 12 and more particularly on rails 36 via mounting legs 44 (FIG. 3) which are removably insertable into openings 46 formed in each of rails 36. Assembly 42 when mounted on frame 12 is positioned so that a central longitudinal axis X of a pilot tube 48 is coaxial with a longitudinal axis Y which passes centrally through output shaft 32 and about which shaft 32 is rotated when driving auger 34. Assembly 42 includes a generally circular rear plate 50 which abuts compartment 30 when assembly 42 is mounted on frame 12 and includes a portion which is inserted into compartment 30 to assist with the alignment of assembly 42.

Also in accordance with the invention, assembly 42 includes first or shorter front and rear mounting assemblies 52 and 54 which also serve as supports providing rigid structure extending laterally across the width of assembly 42. Assemblies 52 and 54, which are described in greater detail further below, are seated on rails 36 of frame 12 when assembly 42 is mounted on frame 12. A pair of axially extending parallel spaced rails 56 and 58 are rigidly mounted on assemblies 52 and 54 and extend along most of the length of assembly 42. Adjustable stabilizing poles 60 are telescopically mounted respectively within first and second rails 56 and 58 and are adjustable to provide force against ground 8 in the same manner as poles 40.

A rigid front cross member 62 extends between and is connected to each of rails 56 and 58 adjacent the front thereof with a front pilot tube support 64 mounted thereon centrally between rails 56 and 58. Support 64 includes a plurality of bearings which engage the pilot tube 48 to allow axial movement of tube 48 along axis X and rotational movement of tube 48 about axis X to allow for the steering thereof. Rear plate 50 and associated structure attached thereto serve as a rear cross member for rigidly connecting rails 56 and 58 to one another at the rear of assembly 42. An intermediate cross member 66 extends laterally between rails 56 and 58 and is supported respectively on rails 56 and 58 by first and second roller assemblies 68 and 70. Each roller assembly includes a pair of upper rollers 72 and lower rollers 74 which respectively rollingly engage upper and lower parallel surfaces 76 and 78 of respective rails 56 and 58.

An electric guidance control motor 80 is mounted on cross member 66 for selectively rotating pilot tube 48 in either direction about axis X. A lubricant feed swivel 82 having a lubricant inlet 84 is mounted on motor 80 by a pair of spaced mounting rods 86 extending forward from motor 80. Swivel 82 is connected to pilot tube 48 and thus serves as an engaging member for drivingly engaging tube 48 during operation of assembly 42. Swivel 82 receives water through inlet 84 to pump the water through pilot tube 48 and through a steering head 88 connected to the front of pilot tube 48, the water flowing out a forward exit opening 90 and a plurality of lateral exit openings 92. A cord carrier 96 is mounted atop rail 56 and includes a plurality of links 98 which are pivotally connected to one another so that electrical cords for powering motor 80 via generator 26 will not become tangled during the driving of pilot tube 48.

Figure 4:
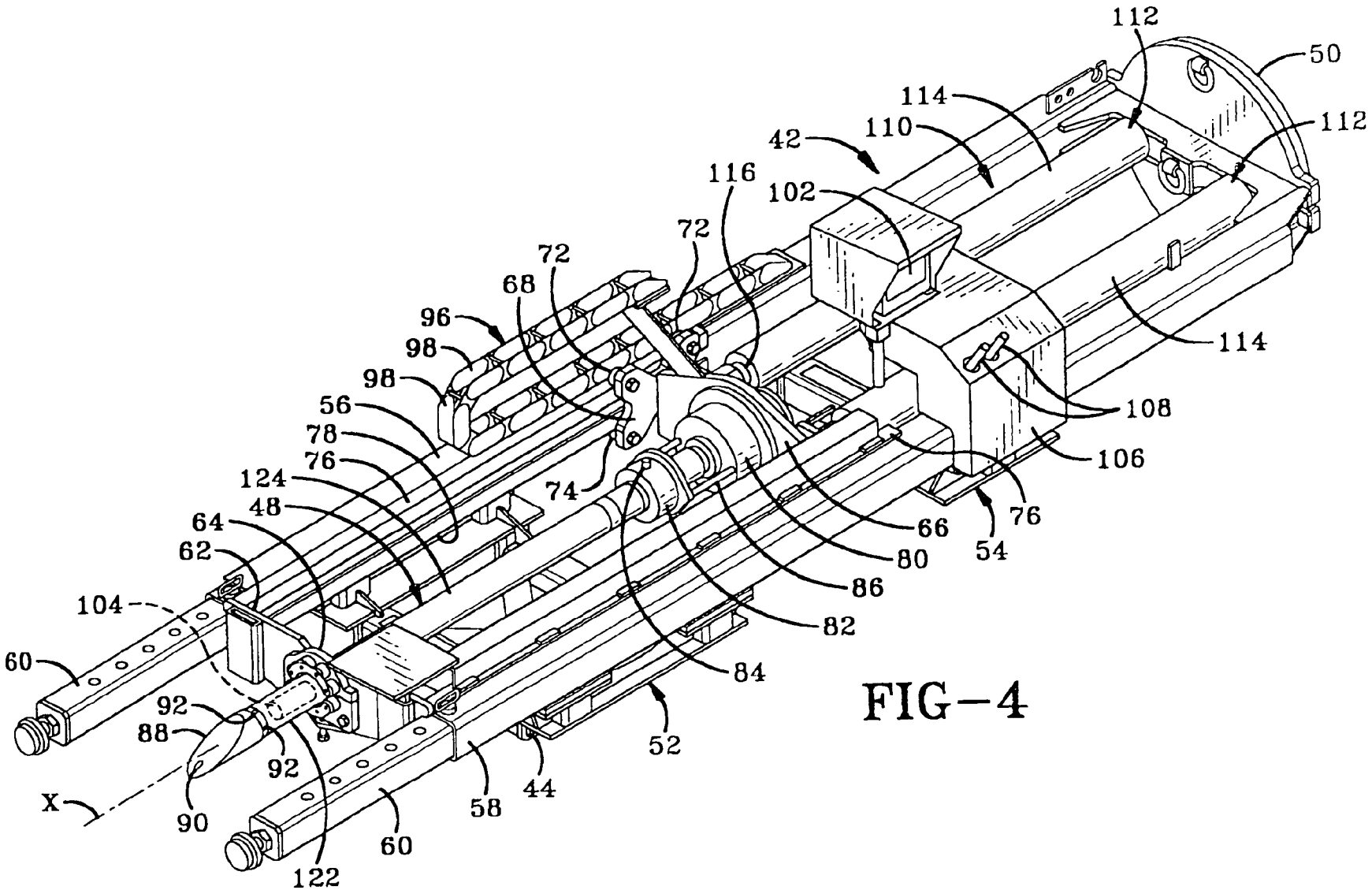
FIG. 4 is a perspective view of the drive assembly.

During the driving of pilot tube 48, a steering mechanism keeps tube 48 on line and grade using a theodolite which utilizes a camera 100 in electrical communication with a display monitor 102 which displays the view of the camera through pilot tube 48 of an illuminated LED target 104 (FIG. 4) disposed within pilot tube 48 adjacent steering head 88. A guidance control unit 106 is mounted on rail 58 and includes manually operable controls 108 in electrical communication with motor 80 in order to send a signal to motor 80 to control rotation of pilot tube 48. Assembly 42 includes a continuous stroke drive mechanism 110 comprising a pair of hydraulic actuators in the form of piston-cylinder combinations 112, which extend and retract simultaneously along paths that are parallel to one another and substantially parallel to axis X of pilot tube 48 to drive pilot tube 48 along axis X. Various drive mechanisms of the pilot tube drive assembly and other details of the present invention are described in further detail in the copending application entitled Method And Apparatus For Providing A Continuous Stroke Auger Boring Machine which is incorporated herein by reference and filed concurrently herewith. It is further noted that rotational output shaft 32 and drive mechanism 110 are commonly powered by engine 24. More particularly, engine 24 powers hydraulic pump 28 which powers piston-cylinder combinations 112. Related aspects of the invention are described in greater detail in copending application entitled Auger Boring Machine With Included Pilot Tube Steering Mechanism which is incorporated herein by reference and filed concurrently herewith.

Figure 5:
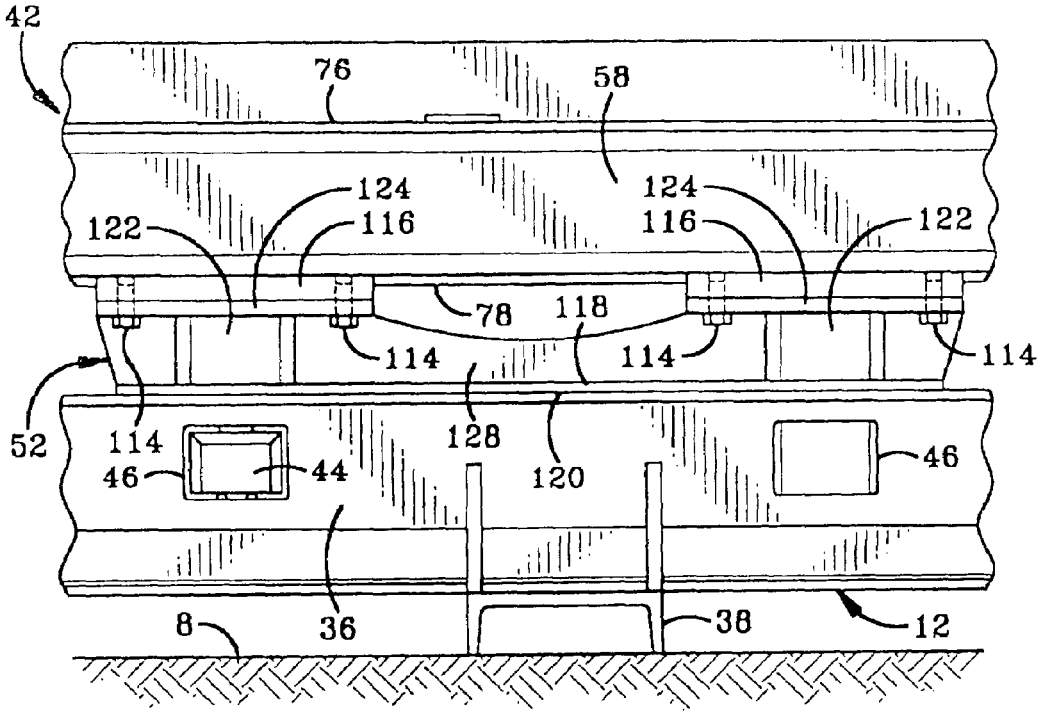
FIG. 5 is an enlarged fragmentary side elevational view of the shorter front mounting assembly shown mounted on the drive assembly and the rails of the first auger boring machine.
Figure 6:
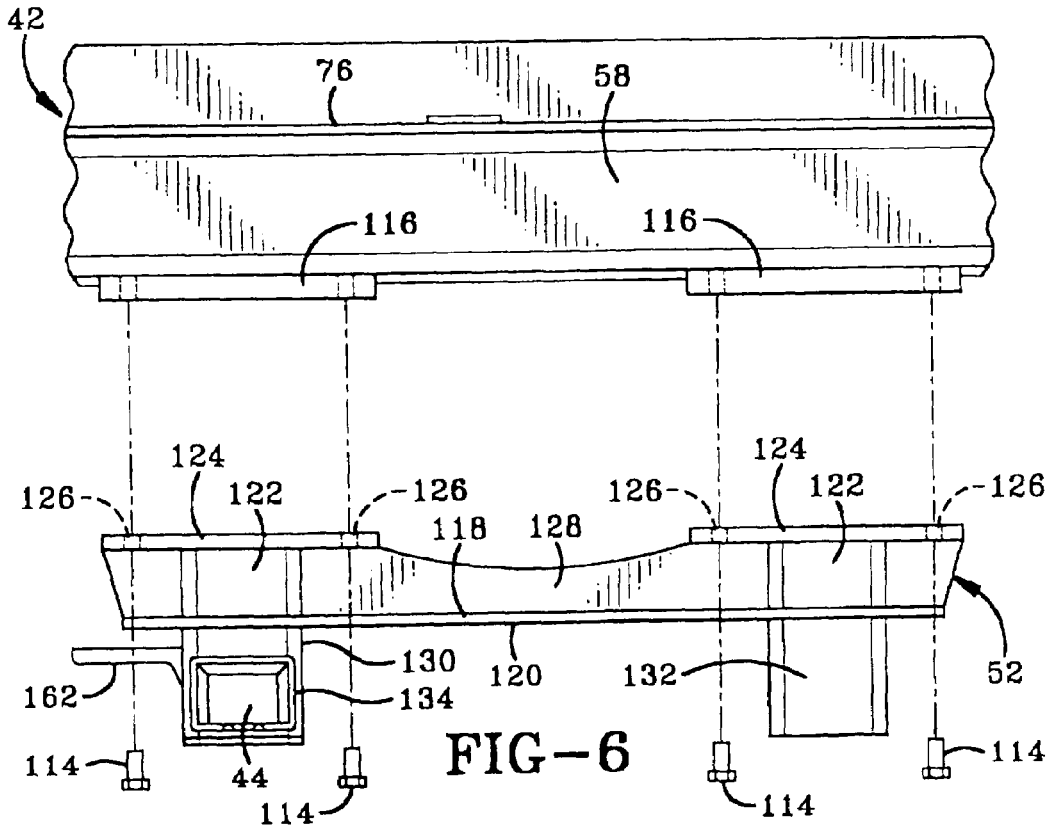
FIG. 6 is similar to FIG. 5 and shows the shorter front mounting assembly removed from the drive assembly and the frame of the first auger boring machine.
Figure 7:
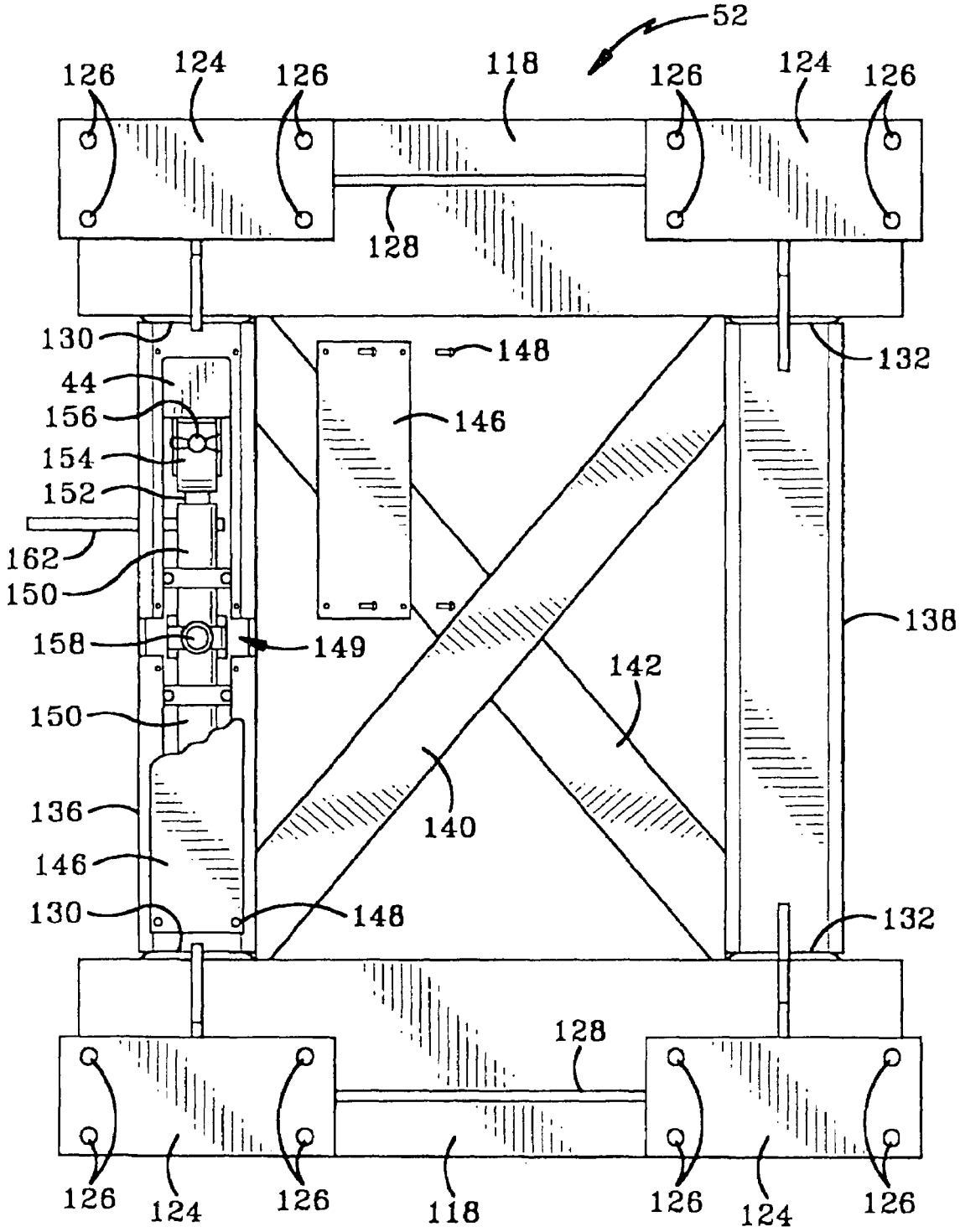
FIG. 7 is a top plan view of the shorter front mounting assembly with one of the cover plates of the mounting leg drive mechanism removed and the other cover plate shown with portions cut away.

In accordance with the invention, shorter mounting assemblies 52 and 54 are now described in greater detail. Assembly 52 is first described with reference to FIGS. 5-7. As shown in FIG. 5, mounting assembly 52 is seated atop rails 36 (only one shown in FIG. 5) and removeably connected to the bottom of the frame of drive assembly 42 by a plurality of bolts 114. More particularly, the frame of assembly 42 has a pair of axially spaced horizontal mounting plates 116 connected to the bottom of each of rails 56 and 58. Each mounting plate 116 defines a plurality of threaded holes which are threadably engaged by bolts 114 to secure assembly 52 to rails 56 and 58. Assembly 52 includes a pair of flat horizontal base plates 118 which are laterally spaced from one another, axially elongated and have lower seating surfaces 120 which are respectively seated atop rails 36 when mounted thereon. A pair of axially spaced hollow upper posts 122 are connected to and extend upwardly from each of base plates 118. A flat horizontal mounting plate 124 is connected atop each upper post 122 and defines a plurality of holes 126 through which bolts 114 respectively extend when assembly 52 is mounted on assembly 42. A vertically oriented strengthening rib 128 extends axially between the pair of upper posts 122 on each plate 118 and is also connected to each of the associated mounting plates 124. The flat upper surface of each mounting plate 124 thus abuts the lower flat surface of each mounting plate 116 when assembly 52 is mounted on assembly 42. Front and rear lower posts 130 and 132 are connected to and extend downwardly from each of base plates 118 and are disposed laterally inwardly of upper post 122. A laterally extending through passage 134 is formed in each of front lower post 130 for receiving therein a respective mounting leg 44. A front crossbar 136 extends laterally between and is connected to each of front lower posts 130. Likewise, a rear crossbar 138 extends laterally between and is connected to each of rear lower posts 132. As viewed from above, first and second braces 140 and 142 (FIG. 7) together form an X-shaped structure extending laterally between base plates 118 and axially between cross bars 136 and 138. More particularly, first brace 140 is connected to the front lower post 130 on one of base plates 118 and the rear lower post 132 on the other base plates 118. Second brace 142 is likewise connected in the opposite fashion.

Figure 11:
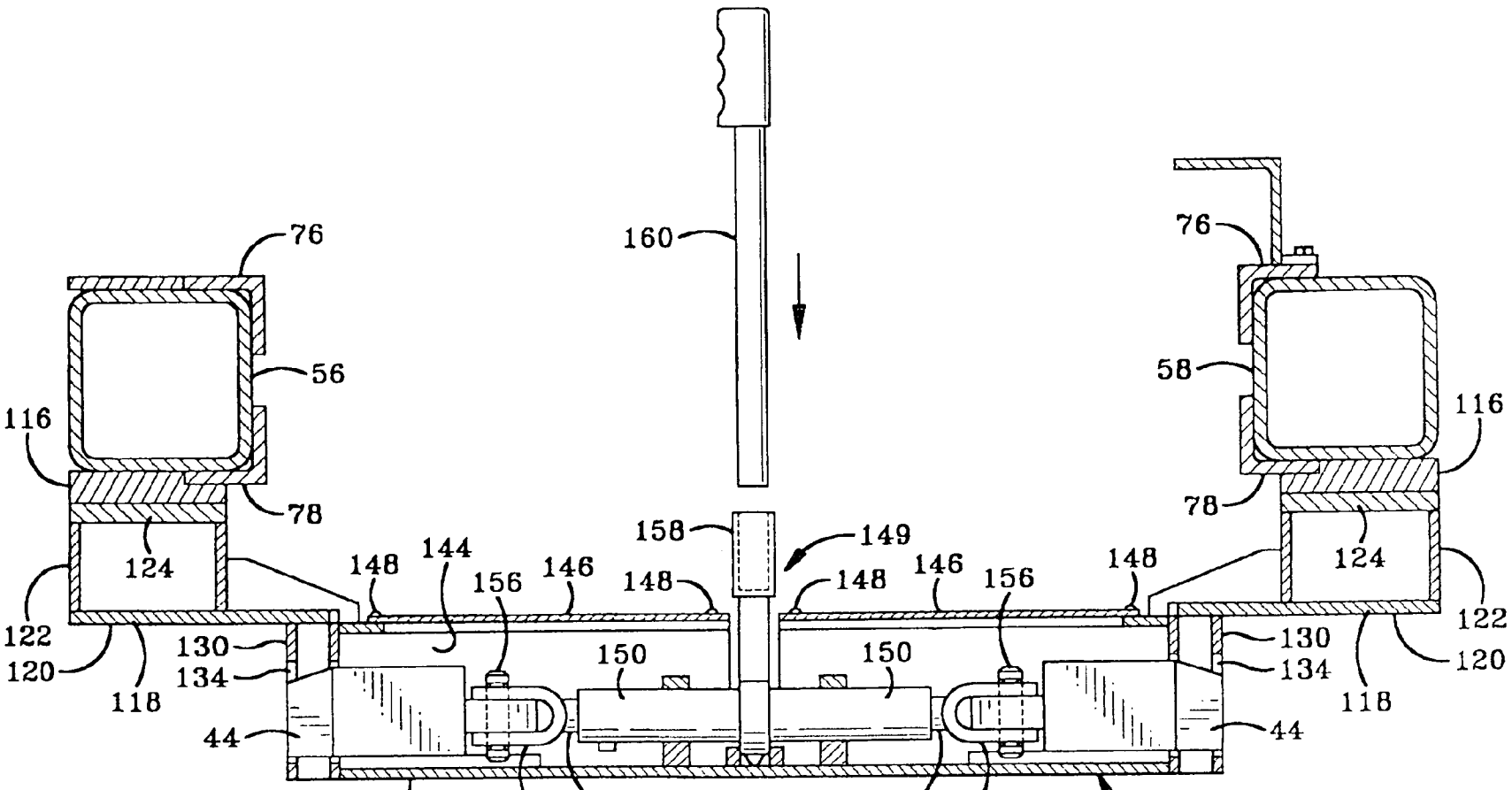
FIG. 11 is a sectional view of the mounting leg drive mechanism in the disengaged position showing a handle being inserted into the crank thereof.
Figure 12:
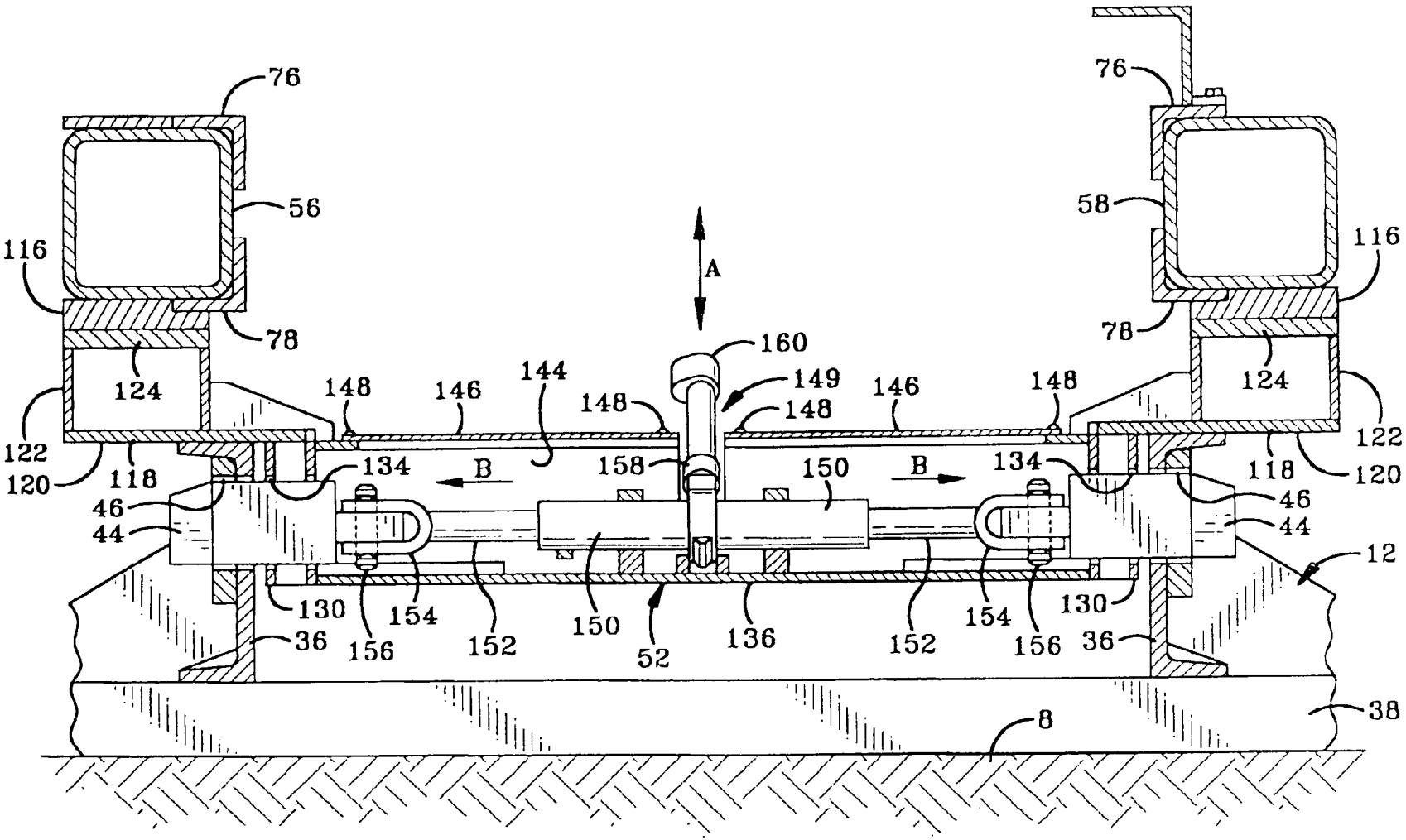
FIG. 12 is similar to FIG. 11 and shows the mounting leg drive mechanism being operated to move the mounting legs outwardly to the engaged position within the openings in the rails of the auger boring machine.

Front cross bar 136 doubles as a housing in which mounting legs 44 are disposed and slidable therein in the lateral direction. Cross bar 136 also houses the drive mechanism or ratchet mechanism which moves mounting legs 44 simultaneously in opposite directions between a disengaged position shown in FIG. 11 and an engaged position shown in FIG. 12. Front cross bar 136 is a hollow member defining an interior chamber 144 and includes a pair of cover plates 146 removably mounted thereon by screws 148 to access chamber 144. An actuating mechanism 149 is positioned between mounting legs 44 partially within interior chamber 144 for moving legs 44 laterally back and forth. In the exemplary embodiment, mechanism 149 includes a ratchet mechanism. A pair of cylinders 150 are positioned on either side of mechanism 149 and a respective pair of pistons 152 are slidably disposed therein and movable via mechanism 149. A mounting clevis 154 is connected to each piston 152 and pivotally mounted on respective mounting leg 44 via a fastener 156 which serves as a pivot. A crank 158 extends upwardly from between cylinders 150 and is configured to removably receive therein a handle 160 for cranking the crank 158 back and forth as indicated by arrow A in FIG. 12 to move mounting legs 44 outwardly as indicated at arrow B. A forward-reverse handle 162 (FIG. 7) is moveable between forward and reverse positions which respectively allow the ratchet mechanism to move mounting legs 44 outwardly to the engaged position and inwardly to the disengaged position in response to the movement of handle 160 and crank 158. To mount assembly 52 on rails 36, lower posts 130 and 132 are positioned between rails 36 respectively closely adjacent thereto with mounting legs 44 aligned with respective openings 46 in rails 36. Handle 160 is then cranked to move mounting legs 44 from the disengaged position in FIG. 11 into the engaged position with mounting legs 44 disposed in openings 46 as shown in FIG. 12.

Figure 8:
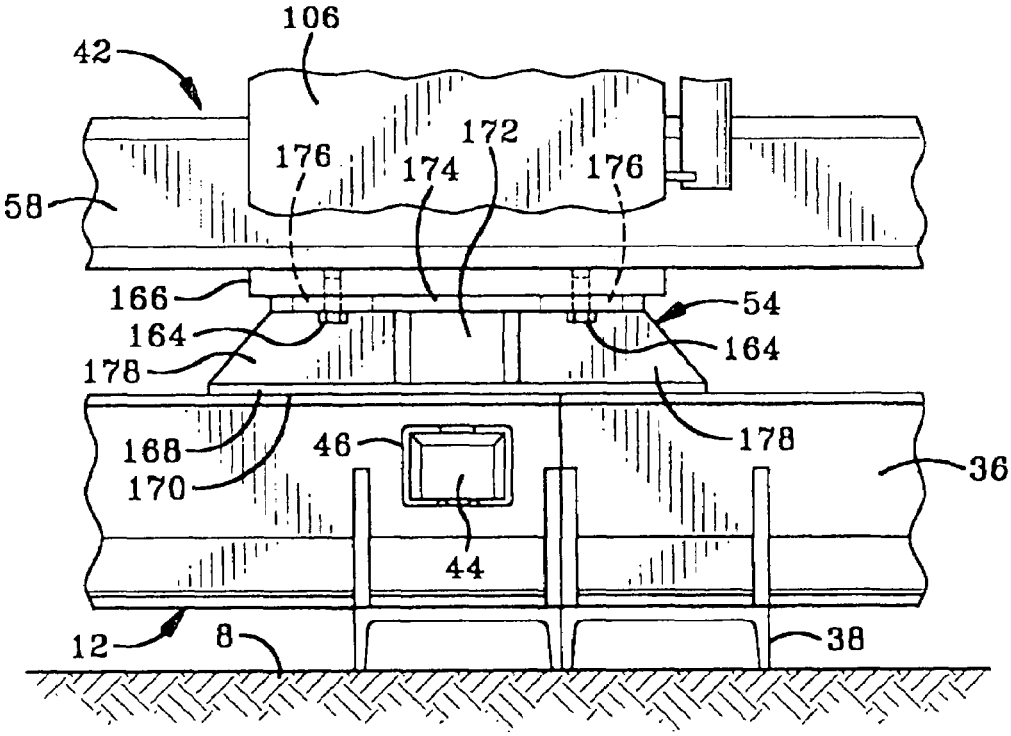
FIG. 8 is an enlarged fragmentary side elevational view of the shorter rear mounting assembly shown mounted on the drive assembly and the rails of the first auger boring machine.
Figure 9:
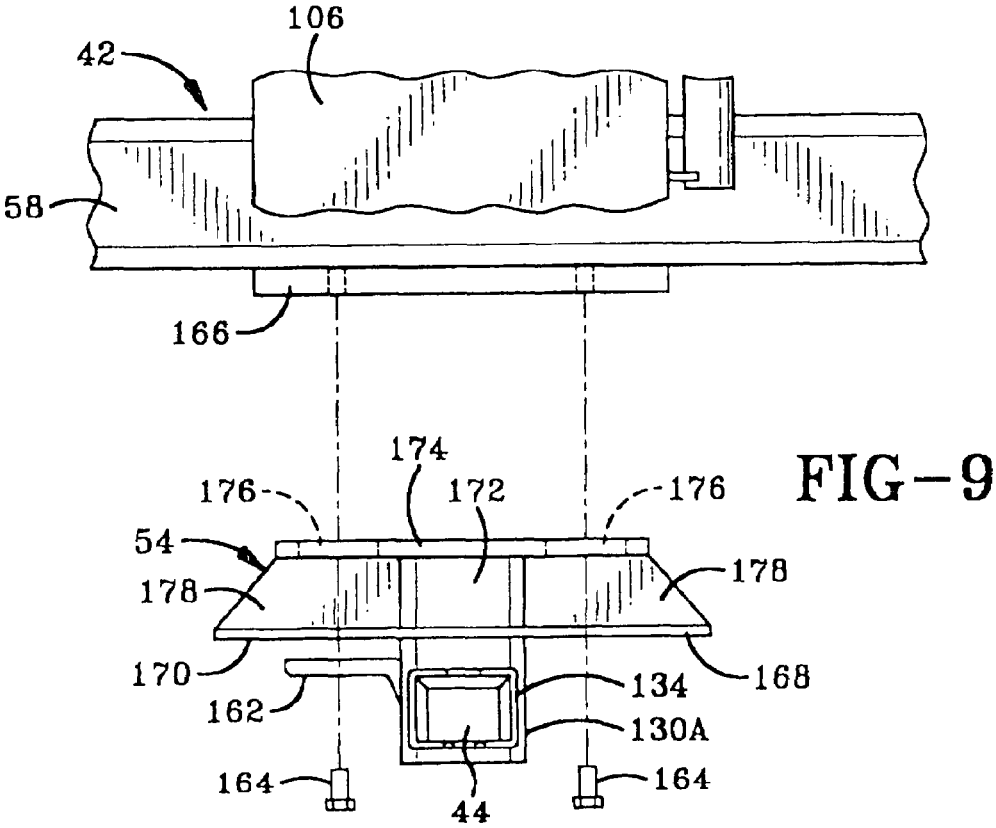
FIG. 9 is similar to FIG. 8 and shows the shorter rear mounting assembly removed from the drive assembly and the first auger boring machine.
Figure 10:
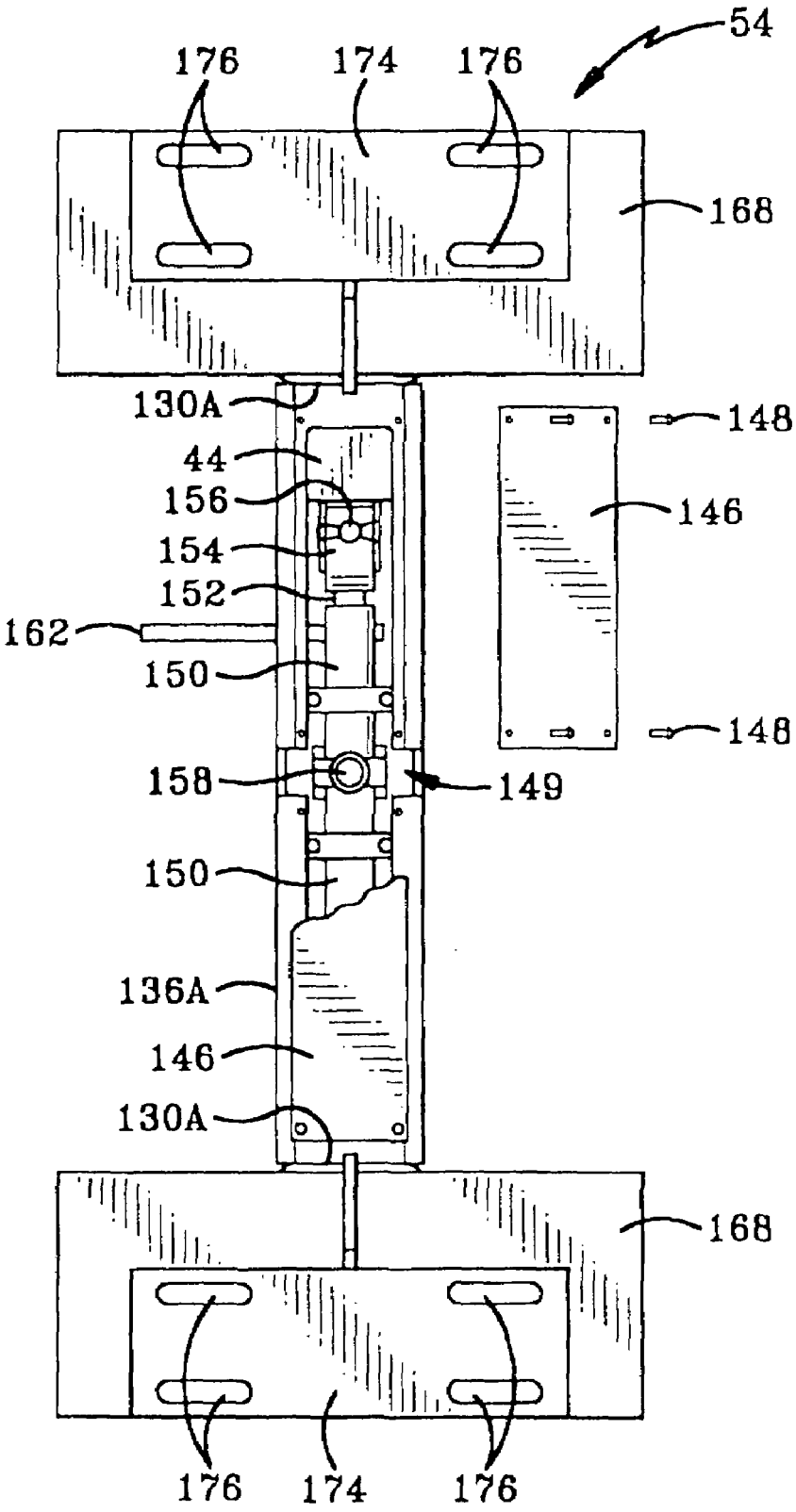
FIG. 10 is a top plan view of the shorter rear mounting assembly showing one cover plate removed and the other with portions cut away.

Referring to FIGS. 8-10, mounting assembly 54 is further described. Like assembly 52, each mounting assembly 54 is seated atop a respective rail 36 when mounted thereon and is connected to drive assembly 42 via a plurality of bolts 164. More particularly, assembly 42 includes a mounting plate 166 connected to the bottom of rail 58 and defining a plurality of threaded holes which are threadably engaged by bolts 164. Assembly 54 includes a pair of laterally spaced horizontal base plates 168 having lower seating surfaces 170 which are seated atop rails 36 when mounted thereon. An upper post 172 extends upwardly from each base plate 168 with a horizontal mounting plate 174 connected atop of each post 172. Each plate 174 defines a plurality of axially elongated poles through which bolts 164 pass when assembly 54 is mounted on assembly 42 with the upper surface of mounting plate 174 abutting the lower surface of mounting plate 176. A pair of vertically oriented strengthening ribs 178 are connected to and extend between base plate 168 and mounting plate 176 with one of ribs 178 extending forward from post 172 and the other extending rearwardly therefrom.

Lower posts 130A extend downwardly from base plate 168 in the same manner that front lower post 130 extend down from base plate 118 of assembly 52. Lower posts 130A have the same configuration as that of post 130 and are therefore not described in further detail. In addition, a cross bar 136A extends between and is connected to each of posts 130A. Cross bar 136A has the same configuration as front cross bar 136 of assembly 52 and houses a ratchet mechanism having the same configuration as that of assembly 52. Thus, cross bar 136A and the associated ratchet mechanism are not described in further detail except to note that they are likewise represented in FIGS. 11 and 12. The elongated slots 176 in mounting plate 174 facilitate the mounting of drive assembly 42 on rails 36 by allowing for some axial movement of assembly 54 to ensure that mounting legs 44 thereof are aligned with respective openings 46 in rails 36 when mounting legs 44 of assembly 52 are disposed in another respective pair of openings 46 in rails 36.

As shown in FIG. 13 when assembly 42 is mounted on rails 36 of machine 10, axis X1 and axis Y1 are coaxial and at a height H1 above a reference point on frame 12 of machine 10 or the bottom of pit 6. In FIG. 13, axis X1 represents the axis along which pilot tube 48 is driven and about which it rotates during steering. Axis Y1 in FIG. 13 represents the axis about which rotational drive shaft 32 rotates when driving an auger and cutting head mounted thereon.

Second embodiment 200 of the auger boring machine of the present invention is shown in FIG. 16 and includes first and second taller mounting assemblies 180 ad 182 instead of shorter mounting assemblies 52 and 54 of machine 10. While assemblies 180 and 182 are respectively taller and have alternate configurations from that of mounting assemblies 52 and 54, they are mounted in the same manner on rail 36 and drive assembly 42 in order to position assembly 42 at a greater height. More particularly, axis X2 and Y2 in FIG. 16 are positioned at a height H2 from the same or an analogous reference point as noted with regard to FIG. 13 so that height H2 is greater than height H1. Again, axis X2 in FIG. 16 represents the axis along which the pilot tube is driven and about which it is rotatable during steering, and axis Y2 represents the axis about which rotational drive 32 of machine 200 is rotated to rotate along with the cutting head mounted thereon. Thus, mounting assemblies 180 and 182 allow drive assembly 42 to be utilized on a boring machine configured to drive a larger diameter auger and cutting head than that used with machine 10.

Figure 14:
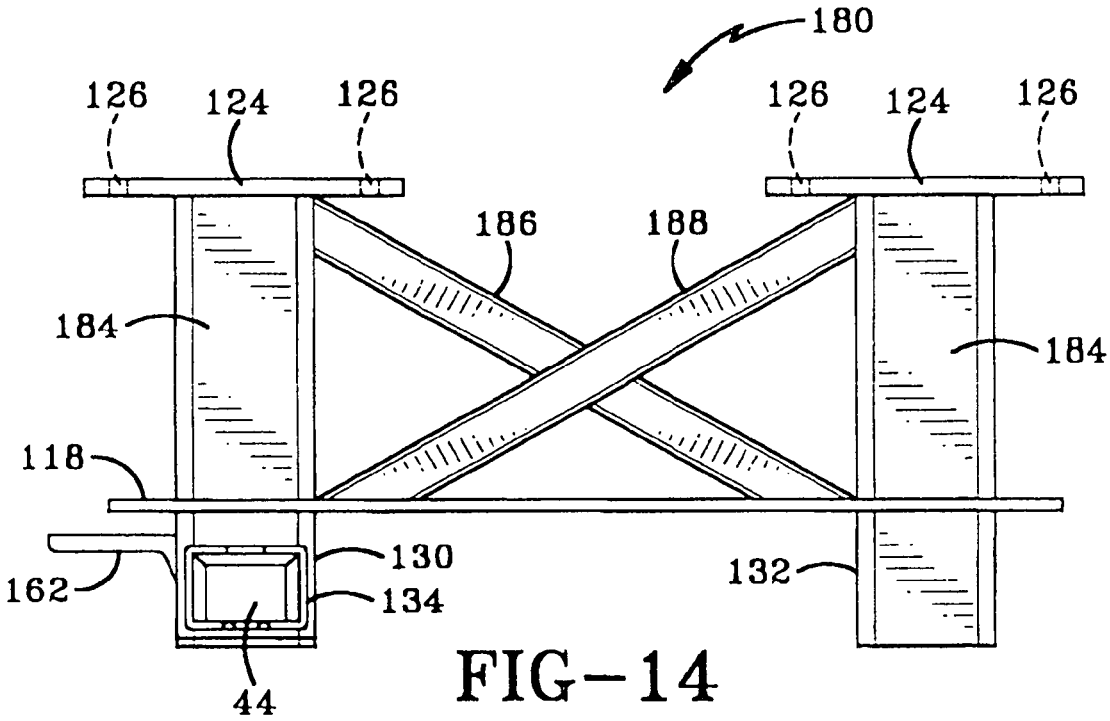
FIG. 14 is a side elevational view of the taller front mounting assembly.

Referring to FIG. 14, first mounting assembly 180 is described. Assembly 180 has various parts which are the same is that of assembly 52 and are thus numbered accordingly. More particularly, assembly 180 includes a pair of base plates 118, mounting plates 124 and lower posts 130 and 132. However, assembly 180 includes a pair of axially spaced upper posts 184 which are taller than upper posts 122 of assembly 52. A pair of braces 186 and 188 together form an X-shaped structure as viewed from the side and extend axially between posts 184. More particularly, each brace 186 and 188 is attached respectively at the upper end of one of posts 184 and to base plate 118 adjacent the lower end of an opposite post 184.

Figure 15:
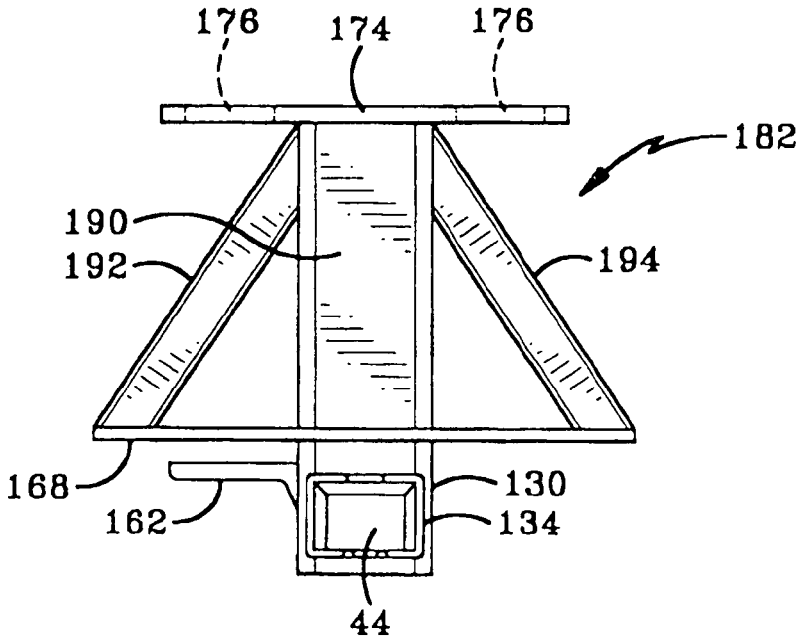
FIG. 15 is a side elevational view of the taller rear mounting assembly.

Referring to FIG. 15, mounting assembly 182 includes parts which are the same as that of assembly 54. More particularly, assembly 182 includes a pair of base plates 168, a pair of mounting plates 174 and a pair of lower posts 130. In addition, assembly 182 includes an upper post 190 which is taller than upper post 172 of assembly 54. A first brace 192 extends between and is connected to the upper end of post 190 and the forward end of base plate 168. Likewise, a second brace 194 extends between and is connected to the upper end of post 190 and the rear end of base plate 168. Each of assemblies 180 and 182 includes a cross bar 136 with the associated ratchet mechanism which operates in the same manner as described with regard to assemblies 52 and 54.

Thus, the present invention provides a height adjustment mechanism for mounting the drive assembly at different heights so that the drive assembly is suitable for use with auger boring machines having rotational outputs of different heights associated with the varying sizes of augers and cutting heads driven thereby.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a pilot tube drive assembly having front and rear ends defining therebetween an axial direction, the drive assembly comprising a drive assembly frame and a pilot tube engaging member movably mounted on the drive assembly frame and adapted to drivingly engage an auger boring machine pilot tube to form in the ground a pilot hole for guiding an auger;

a drive mechanism for driving the engaging member in the axial direction along a laterally extending axis;

a taller mounting assembly which is removably mountable on the drive assembly frame and extends downwardly from the drive assembly frame when mounted thereon to set a first height of the engaging member and axis;

a shorter mounting assembly which is mountable on and extends downwardly from the drive assembly frame to set a second height of the engaging member and axis when the taller mounting assembly is removed from the drive assembly frame; wherein the second height is lower than the first height; and an auger boring machine frame having an auger rotational drive mounted thereon adapted for rotatably driving the auger; and wherein the drive assembly frame is higher relative to the auger boring machine frame when the taller mounting assembly is mounted on the auger boring machine frame and the drive assembly frame than when the shorter mounting assembly is mounted on the auger boring machine frame and the drive assembly frame.

2. The apparatus of claim 1 wherein the shorter mounting assembly is removably mountable on the frame.

3. The apparatus of claim 2 wherein the shorter mounting assembly is mountable on the frame at a first location; and the taller mounting assembly is alternately mountable on the frame at the first location.

4. The apparatus of claim 1 wherein the taller mounting assembly comprises first and second separate supports extending downwardly from the frame and axially spaced from one another.

5. The apparatus of claim 4 wherein the shorter mounting assembly comprises third and fourth separate supports extending downwardly from the frame and axially spaced from one another.

6. The apparatus of claim 5 wherein the first and second supports are mountable on the drive assembly frame respectively at first and second locations; and the third and fourth supports are alternately mountable on the drive assembly frame respectively at the first and second locations.

7. The apparatus of claim 1 further comprising an auger boring machine frame adapted for rotatably mounting thereon the auger and on which the taller and shorter mounting assemblies are removably mountable.

8. The apparatus of claim 7 wherein the auger boring machine frame comprises a pair of parallel spaced rails on which the mounting assemblies are seated when mounted thereon.

9. The apparatus of claim 1 wherein the taller mounting assembly must be removed from the drive assembly frame in order for the shorter mounting assembly to function to set the second height.

10. An apparatus comprising:

a pilot tube drive assembly having front and rear ends defining therebetween an axial direction, the drive assembly comprising a drive assembly frame and a pilot tube engaging member movably mounted on the drive assembly frame and adapted to drivingly engage an auger boring machine pilot tube to form in the ground a pilot hole for guiding an auger;

a drive mechanism for driving the engaging member in the axial direction along a laterally extending axis;

a taller mounting assembly which is removably mountable on the drive assembly frame and extends downwardly from the drive assembly frame when mounted thereon to set a first height of the engaging member and axis; wherein the taller mounting assembly comprises first and second separate supports extending downwardly from the frame and axially spaced from one another;

a shorter mounting assembly which is mountable on and extends downwardly from the drive assembly frame to set a second height of the engaging member and axis when the taller mounting assembly is removed from the drive assembly frame; wherein the second height is lower than the first height;

a first set of holes formed in the first support;

a second set of holes formed in the second support;

a third set of holes formed in the frame;

a fourth set of holes formed in the frame;

a plurality of first fasteners extending respectively through the holes in the first and third sets for securing the first support to the frame;

a plurality of second fasteners extending respectively through the holes in the second and fourth sets for securing the second support to the frame; and wherein the holes in at least one of the sets is axially elongated.

11. The apparatus of claim 10 further comprising an auger boring machine frame having an auger rotational drive mounted thereon adapted for rotatably driving the auger; and wherein the drive assembly frame is higher relative to the auger boring machine frame when the taller mounting assembly is mounted on the auger boring machine frame and the drive assembly frame than when the shorter mounting assembly is mounted on the auger boring machine frame and the drive assembly frame.

12. An apparatus comprising:

a pilot tube drive assembly having front and rear ends defining therebetween an axial direction, the drive assembly comprising a drive assembly frame and a pilot tube engaging member movably mounted on the drive assembly frame and adapted to drivingly engage an auger boring machine pilot tube to form in the ground a pilot hole for guiding an auger;

a drive mechanism for driving the engaging member in the axial direction along a laterally extending axis;

a taller mounting assembly which is removably mountable on the drive assembly frame and extends downwardly from the drive assembly frame when mounted thereon to set a first height of the engaging member and axis;

a shorter mounting assembly which is mountable on and extends downwardly from the drive assembly frame to set a second height of the engaging member and axis when the taller mounting assembly is removed from the drive assembly frame; wherein the second height is lower than the first height; and an auger boring machine frame adapted for rotatably mounting thereon the auger; and wherein the taller mounting assembly is removably mountable on the auger boring machine frame;

the taller mounting assembly sets the first height when mounted on the auger boring machine frame; and the drive assembly frame is removable from the auger boring machine frame via removal of the taller mounting assembly from the auger boring machine frame.

13. The apparatus of claim 12 wherein the drive assembly frame is higher relative to the auger boring machine frame when the taller mounting assembly is mounted on the auger boring machine frame and the drive assembly frame than when the shorter mounting assembly is mounted on the auger boring machine frame and the drive assembly frame.

14. The apparatus of claim 12 wherein the drive assembly frame, drive mechanism and pilot tube engaging member are removable as a unit from the auger boring machine frame via removal of the taller mounting assembly from the auger boring machine frame.

15. The apparatus of claim 14 further comprising an auger rotational drive mounted on the auger boring machine frame and adapted to drive rotation of the auger; and wherein the auger rotational drive remains on the auger boring machine frame when the unit is removed from the auger boring machine frame.

16. The apparatus of claim 12 wherein the shorter mounting assembly is removably mountable on the auger boring machine frame; the shorter mounting assembly sets the second height when mounted on the auger boring machine frame; and the drive assembly frame is removable from the auger boring machine frame via removal of the shorter mounting assembly from the auger boring machine frame.

17. The apparatus of claim 12 wherein the drive assembly frame is higher relative to the auger boring machine frame when the taller mounting assembly is mounted on the auger boring machine frame and the drive assembly frame than when the shorter mounting assembly is mounted on the auger boring machine frame and the drive assembly frame.

18. An apparatus comprising:

a pilot tube drive assembly having front and rear ends defining therebetween an axial direction, the drive assembly comprising a drive assembly frame and a pilot tube engaging member movably mounted on the drive assembly frame and adapted to drivingly engage an auger boring machine pilot tube to form in the ground a pilot hole for guiding an auger;

a drive mechanism for driving the engaging member in the axial direction along a laterally extending axis;

a taller mounting assembly which is removably mountable on the drive assembly frame and extends downwardly from the drive assembly frame when mounted thereon to set a first height of the engaging member and axis;

a shorter mounting assembly which is mountable on and extends downwardly from the drive assembly frame to set a second height of the engaging member and axis when the taller mounting assembly is removed from the drive assembly frame; wherein the second height is lower than the first height; and an auger boring machine frame adapted for rotatably mounting thereon the auger; and wherein the shorter mounting assembly is removably mountable on the auger boring machine frame;

the shorter mounting assembly sets the second height when mounted on the auger boring machine frame; and the drive assembly frame is removable from the auger boring machine frame via removal of the shorter mounting assembly from the auger boring machine frame.

19. The apparatus of claim 18 wherein the drive assembly frame, drive mechanism and pilot tube engaging member are removable as a unit from the auger boring machine frame via removal of the shorter mounting assembly from the auger boring machine frame.

20. The apparatus of claim 18 wherein the drive assembly frame is higher relative to the auger boring machine frame when the taller mounting assembly is mounted on the auger boring machine frame and the drive assembly frame than when the shorter mounting assembly is mounted on the auger boring machine frame and the drive assembly frame.

* * * * *